US006088848A

United States Patent [19]

Waterlyn

[11] Patent Number: 6,088,848

[45] Date of Patent: Jul. 18, 2000

[54] PORTABLE SHOWER FOR INVALIDS

[76] Inventor: Timothy Waterlyn, 7254 Gettysburg Dr., Magna, Utah 84044

[21] Appl. No.: 09/212,333

[22] Filed: Dec. 15, 1998

[51] Int. Cl.[7] ..... A47K 3/06

[52] U.S. Cl. ..... 4/585

[58] Field of Search ..... 4/585, 586

[56] References Cited

U.S. PATENT DOCUMENTS

| | | | |
|---|---|---|---|
| 1,096,672 | 5/1914 | Boniface | 4/586 |
| 2,432,147 | 12/1947 | Freund | 5/317 |
| 3,083,376 | 4/1963 | Johns | 4/621 |
| 3,755,830 | 9/1973 | Johns | 4/585 |
| 4,002,330 | 1/1977 | Johansson | 269/327 |
| 4,152,792 | 5/1979 | Glintz | 4/585 |
| 4,312,084 | 1/1982 | Browning | 4/585 X |
| 4,338,691 | 7/1982 | Gaffney | 4/562.1 |
| 4,434,517 | 3/1984 | Dorris | 4/585 |
| 4,583,252 | 4/1986 | McCourt | 4/584 |
| 4,890,343 | 1/1990 | Schlags | 4/585 |
| 4,982,462 | 1/1991 | Wada | 4/546 |
| 5,054,136 | 10/1991 | Inagaki | 4/546 |
| 5,136,735 | 8/1992 | Zimmerman | 4/597 |
| 5,251,345 | 10/1993 | Pechner | 4/603 |
| 5,522,099 | 6/1996 | Heier | 5/606 |

FOREIGN PATENT DOCUMENTS

| | | | |
|---|---|---|---|
| 673488 | 1/1930 | France | 4/585 |
| 1729 | of 1876 | United Kingdom | 4/585 |
| 5565 | of 1895 | United Kingdom | 4/585 |

OTHER PUBLICATIONS

Donna Kennedy, How to Contribute to Society When You Work, Dayton Daily News, Jan. 3, 1997.

Shower Anywhere, located at "http://www.shower–anywhere.com," 3 pages, website last modified Jul. 16, 1997.

Portable Bath–In–Bed (PBB–1), located at "http://www-.shower– anywhere.com/pbbl/htm," 2 pages, website last modified Jul. 16, 1997.

Product List, located at "http://www.shower–anywhere-.com/salist.htm," 2 pages, website last modified Jul. 16, 1997.

Lifestyle Innovations, located at "http://user.aol.com/lifeinn/bedshower.htm," 2 pages, web page last modified Jun. 7, 1998.

Parts of the Bedshower, located at "http://user.aol.com/lifeinn/pics.htm," 1 page, web page last modified Feb. 10, 1998.

The Containment Unit located at "http://user.aol.com/lifeinn/cmu.htm," 3 pages, web page last modified Feb. 10, 1998.

How It Works, located at "http://user.aol.com/lifeinn/works.htm," 3 pages, web page last modified Apr. 6, 1998.

Helpful Hints, located at "http://users.aol.com/lifeinn/hints.htm," 2 pages, web page last modified Apr. 6, 1998.

Frequently Asked Questions, located at "http://users.aol-.com/lifeinn/faq.htm," 2 pages, web page last modified Apr. 6, 1998.

Ordering Information, located at http://users.aol.com/lifeinn/order.htm, 2 pages, web page last modified Apr. 6, 1998.

*Primary Examiner*—Robert M. Fetsuga

*Attorney, Agent, or Firm*—Workman Nydegger Seeley

[57] ABSTRACT

A modular portable shower with an impermeable liner and a modular frame that permits to shower a bedridden person while lying on bed. This level of comfort is provided to bedridden persons with the aid of an impermeable liner that can be extended and removed as one would extend or remove a bed sheet. The impermeable liner is held by the modular frame in a position that prevents overspraying and affords the bedridden person being showered some privacy. The modular portable shower can be disassembled to be compactly stored.

20 Claims, 7 Drawing Sheets

PORTABLE SHOWER FOR INVALIDS

BACKGROUND OF THE INVENTION

1. The Field of the Invention

The present invention relates generally to devices for allowing a person who is confined to a bed to take a shower. More specifically, the present invention relates to a modular device that permits a bedridden person to take a shower in a conventional bed that requires no special mattress or bed frame.

2. Present State of the Art

Although sponge baths satisfy some of the hygienic needs of a bed ridden person, full showers are preferable because their administration leads to better hygiene and also to a greater enjoyment by the person who is confined to a bed. Under certain circumstances, showers may also be preferable because the cleansing effect is accomplished by running water instead of by the rubbing of a water impregnated object such as a sponge. Shower cleansing does not require the contact with the patient's skin of any cleansing pad, sponge or any other means for rubbing skin. Avoiding rubbing the skin is particularly important because the skin of a bedridden person might not tolerate the slightest degree of abrasion or even mild rubbing.

The terms "bedridden person" will hereinafter be used to designate an invalid, a valetudinarian, a patient, a convalescent person, and in general any person who is confined to a bed regardless of the nature and character of the disabling ailment, infirmity or any other cause that prevents such person from leaving bed.

Some of the traditional methods of administering showers to bedridden persons require the transfer of the person from the bed to another surface, platform or receptacle. This transfer is accomplished by lifting the person from the bed and subsequently depositing the person in the place where the shower is to be administered. Some devices require a transfer by sliding the person from the bed to another surface that is not the bed surface itself. In any case, after a shower is administered, the person is returned to bed by the reverse process. Devices for administering showers to bedridden persons that require the transfer of the person from the bed to another surface or the lifting of the person from the bed have been disclosed in U.S. Pat. Nos. 5,054,136, 4,982,462, and 4,338,691. The transfer of the person away from and then back onto the bed leads to discomfort, it is time consuming, requires specialized equipment, and it may require the assistance of several people. Furthermore, the affliction that confines a person to a bed may render the bedridden person in such condition that the transfer away from and back onto the bed is simply not tolerated.

Other devices for administering showers to bedridden persons require the use of impermeable mattresses, modified mattresses, specially designed bed frames, or the use of tilting devices. Whereas the use of these devices allows the patient to remain on the bed while showering, the modified features of the mattress or bed frame render them somewhat cumbersome for their use in a common household. In addition, the specialization and cost of these devices may also be prohibitive for an ordinary household where the presence of a bedridden person is an exceptional event. Devices for administering showers to bedridden persons that require the use of a special mattress, bed frame, or tilting device have been disclosed in U.S. Pat. Nos. 5,522,099, 5,136,735, 4,002,330, and 2,432,147.

Other available devices rely on platforms designed for collecting the water released in sponge baths administered to localized areas of the bedridden person's body. These devices do no permit the administration of a full body shower because they are not designed for collecting the water within an area as large as the entire body surface. Devices for administering sponge baths to a bedridden person or to a person lying in bed have been disclosed in U.S. Pat. Nos. 4,583,252 and 3,083,376.

Conventional devices for administering showers are usually not suitable for easy and variable adjustment to different bed sizes. This limitation might not be very relevant to devices that are designed for their use in health care facilities because these facilities usually have an inventory of beds that are standard in size. However, a significant number of bedridden persons reside at home, where beds of different sizes are common. In particular, it is common for children to have beds that are smaller than beds for adult people.

Other available devices for administering showers to bedridden persons rely on platforms or receptacles that have to be supplemented by covers or screens to prevent water spillage when the shower is administered. These devices have joints that add complexity to the device, increase the probability of developing leaks, and require a number of assembly and disassembly steps that might be too time consuming. Furthermore, their storage requires more space than that required by a comparatively simpler device with a smaller number of components. A device with an elevated non-transparent flexible cover for administering showers to bedridden persons has been disclosed in U.S. Pat. No. 4,152,792.

Although considerable attention has been given to the design of devices for comfortably administering showers to bedridden persons, few devices are so simple that they can conveniently be utilized at home by non-specialized personnel and yet meet the needs of professional health care facilities. Even fewer devices have these characteristics while requiring no specialized bed or mattress components. Furthermore, the number of available devices with all these characteristics is considerably diminished or perhaps reduced to zero when in addition, the bedridden person is to remain on the bed during the entire cycle that comprises the set up, shower administration, and removal of the device.

Conventional devices for administering showers to bedridden persons are not easy to assemble and disassemble, can seldom be stored in a small area, are usually not adjustable to beds of different sizes and some of them require displacements of the bedridden person that are intolerable. It is therefore desirable to provide a device for administering showers to bedridden persons that can easily be adjusted to different bed sizes; that can be easily assembled and disassembled; that can be used by nonspecialized personnel with minimal or no maintenance requirements; that are highly portable; and that effectively retain water and prevent water spills on the bed or any surrounding area that is to be kept dry. In addition, using such device should not require the transfer or even a prohibitive displacement of the bedridden person to whom the shower is to be administered. Furthermore, the device should be manufactured with simple, durable, readily available and replaceable materials, and it should be suitable for use at home as well as at a health care facility.

SUMMARY AND OBJECTS OF THE INVENTION

A full body shower satisfies a bedridden person's hygienic needs and it may also provide a degree of comfort and pleasure that would be unattainable if different hygienic practices were adopted. To deliver the shower with minimal movement of the bedridden person, any transfer to a place other than the bed surface itself should be avoided, yet a suitable device must be used to prevent the water from spilling over the bed. This device should not be so complex that its cost, operation or storage becomes prohibitive to the regular household. Nevertheless, the device has to be an effective portable shower that can be used at home and at a health care facility as well. Furthermore, the portable shower has to be specialized enough to be effectively used without diminishing the bedridden person's comfort level, and it should be leak-proof and simple enough as to be effectively used on the bed itself and yet prevent the water from spilling on the bed by overspraying. It should also be modular and capable of easy assembly and disassembly, and compact enough for its storage in a reduced area. Furthermore, the drain mechanism should be simple and reliable and the materials of which the portable shower is made must be durable and inexpensive enough as to be affordable to the ordinary household. To be simple and compact, the portable shower should also have a small number of component parts, and its modular character should allow for its assembly in configurations of variable size so that it can be used on beds of different sizes.

A portable shower with characteristics that include the foregoing features is desirable. The general object of this invention is to provide a modular portable shower for allowing a bedridden person to take a shower while lying on bed, whether at home or at a health care facility.

It is further object of this invention to provide a modular portable shower whose utilization leads to minimal discomfort. It is in particular a further object of the invention to provide a portable shower whose operation does not require moving the bedridden person away from or even out of the bed. More particularly, an object of this invention is to provide a portable shower whose use merely requires a bedridden person's movement that is similar to that required by the change of the bed sheets. Because the modular portable shower of this invention permits the bedridden person to enjoy the comfort of a regular mattress and it requires minimal or no discomfort to be caused while satisfying the bedridden person's hygienic needs, it advantageously provides comfort and pleasure to the bedridden person and requires minimal efforts from attendants providing health care.

It is a further object of this invention to provide a modular portable shower that is reusable, that operates with simple and uncomplicated mechanical elements that can be easily assembled and disassembled, and that can be manufactured with simple and ordinarily available materials by well-known processes, thus rendering the modular portable shower durable, resistant to wear, and easy to maintain, clean and replace. More particularly, it is a further object of this invention to provide a modular portable shower that can be assembled in different sizes so that it can conveniently and advantageously fit on beds of different sizes. Because the impermeable liner of the portable shower of this invention is detachable from the frame, the portable shower of this invention is modular. Furthermore, because the frame of the modular portable shower of this invention can be disassembled into smaller elements, the frame of the modular portable shower of this invention itself is modular. Thus, the portable shower of this invention has an overall modular character that permits to advantageously disassemble it into a set of components that is reduced in number and compact for easy storage.

It is a further object of this invention to provide a portable shower that effectively prevents the water from spilling over the bed without relying on additional confining structures that would need sealed joints or would be cumbersome to assemble or to store. In addition, the modular portable shower of this invention does not require special bed frames, tilting devices, specially designed or impermeable mattresses, or even the modification of the shape or features of conventional beds and mattresses.

It is a further object of this invention to provide a modular portable shower from which water can easily be drained. This object is accomplished in the present invention by a means for draining water that can be coupled, if so desired, to a pumping device, thus advantageously evacuating water so that there is no significant water accumulation in the shower.

These and other objects of this invention are achieved by a modular portable shower comprising an impermeable liner and a frame that is made up of detachable elements. This liner is attachable to the frame and, preferably, the liner has at least one drain that allows for the continuous evacuation of the water that would otherwise accumulate within the liner.

Additional objects and advantages of the invention will be set forth in the description which follows, and in part will be obvious from the description, or maybe learned by the practice of the invention. The objects and advantages of the invention maybe realized and obtained by means of the instruments and combinations particularly pointed out in the appended claims.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to portable showers. More particularly, the present invention relates to a portable shower with an impermeable liner and a frame that is made up of detachable elements. This portable shower can be assembled on top or around a bed for administering a shower to a bedridden person and avoiding overspraying. The exemplary embodiments shown in FIGS. 1–7 illustrate features of exemplary embodiments of the present invention that will be discussed hereinbelow.

One of the primary components of the modular portable shower of this invention include a liner means for protecting the bed from overspraying while the bedridden person is being showered. In a most preferred embodiment of the shower shown at 10, this liner means is embodied by an impermeable liner, of which impermeable liner 20 is an exemplary embodiment. Another primary component of the shower is a frame means for supporting the liner means. An exemplary embodiment of a frame means is frame 50. The liner means is configured to receive a bedridden person while lying on a bed and it is attached to the portable shower's frame means to avoid overspraying. The portable shower also has a drain means for draining the water from the liner as a bedridden person is showered.

Figure 1:
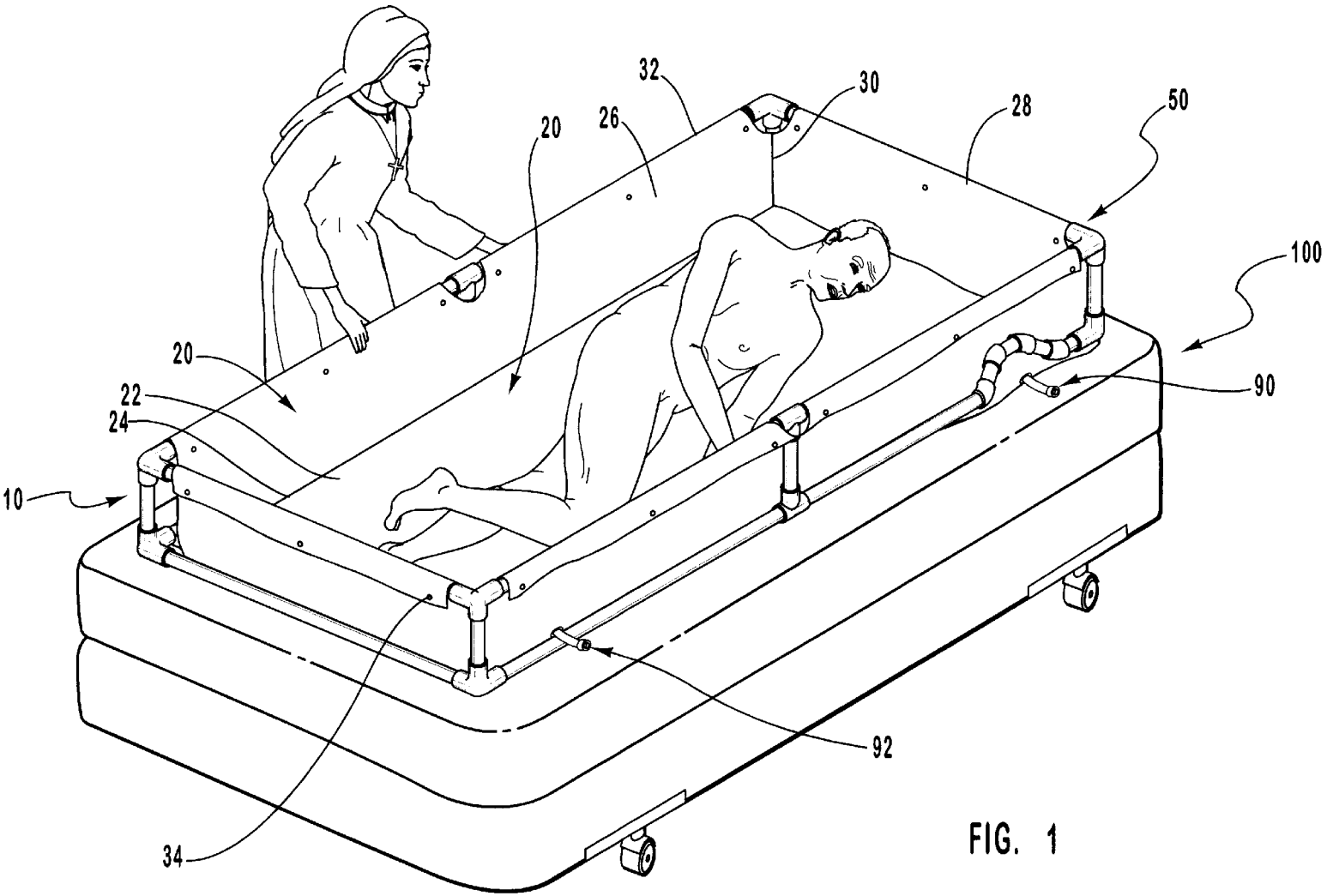
FIG. 1 is a perspective view of an embodiment of the modular portable shower with a bedridden person lying on the impermeable liner that is attached to a modular frame on a bed mattress.
Figure 2:
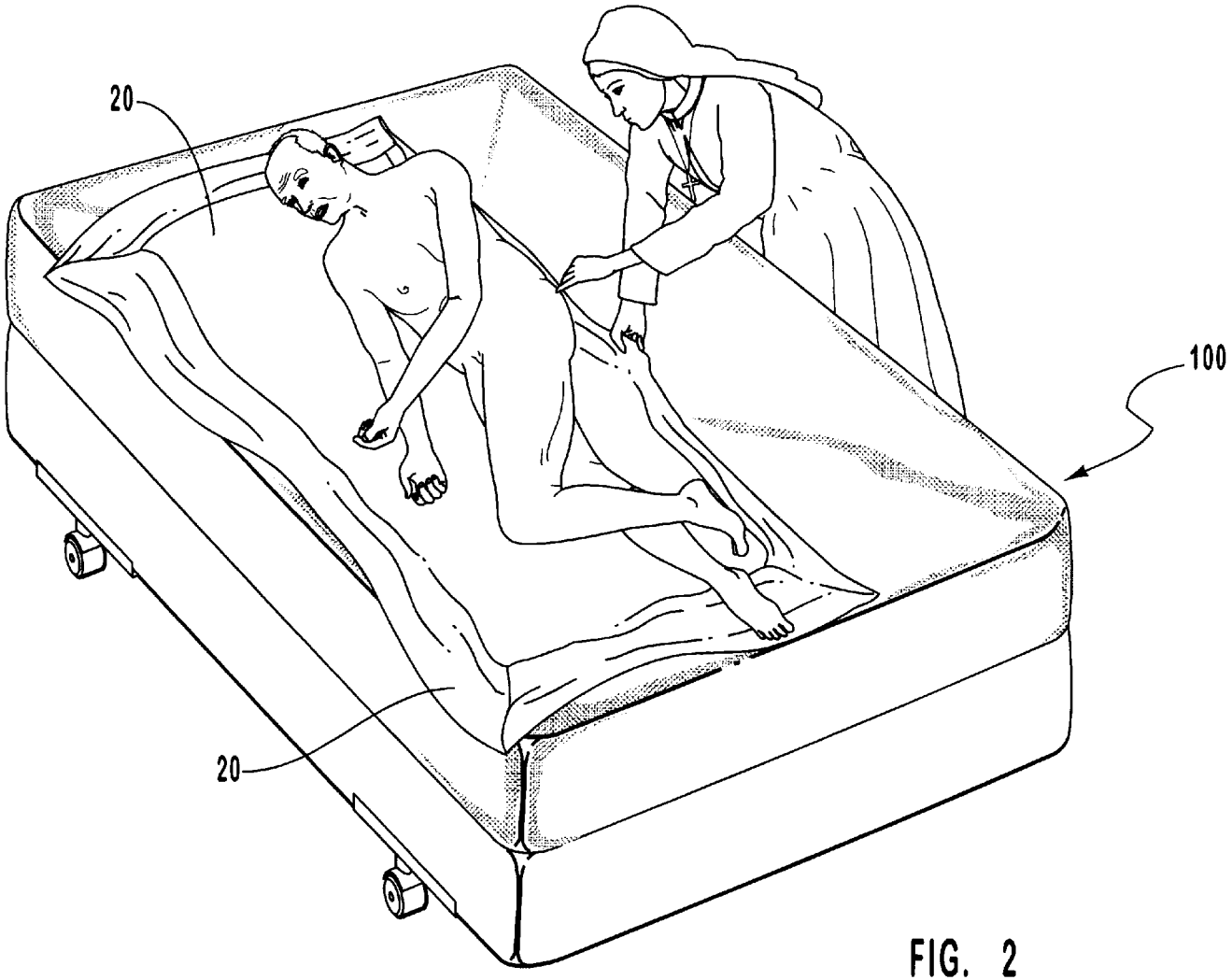
FIG. 2 is a perspective view of the impermeable liner of an embodiment of the modular portable shower being extended on a bed mattress under a bedridden person.
Figure 3:
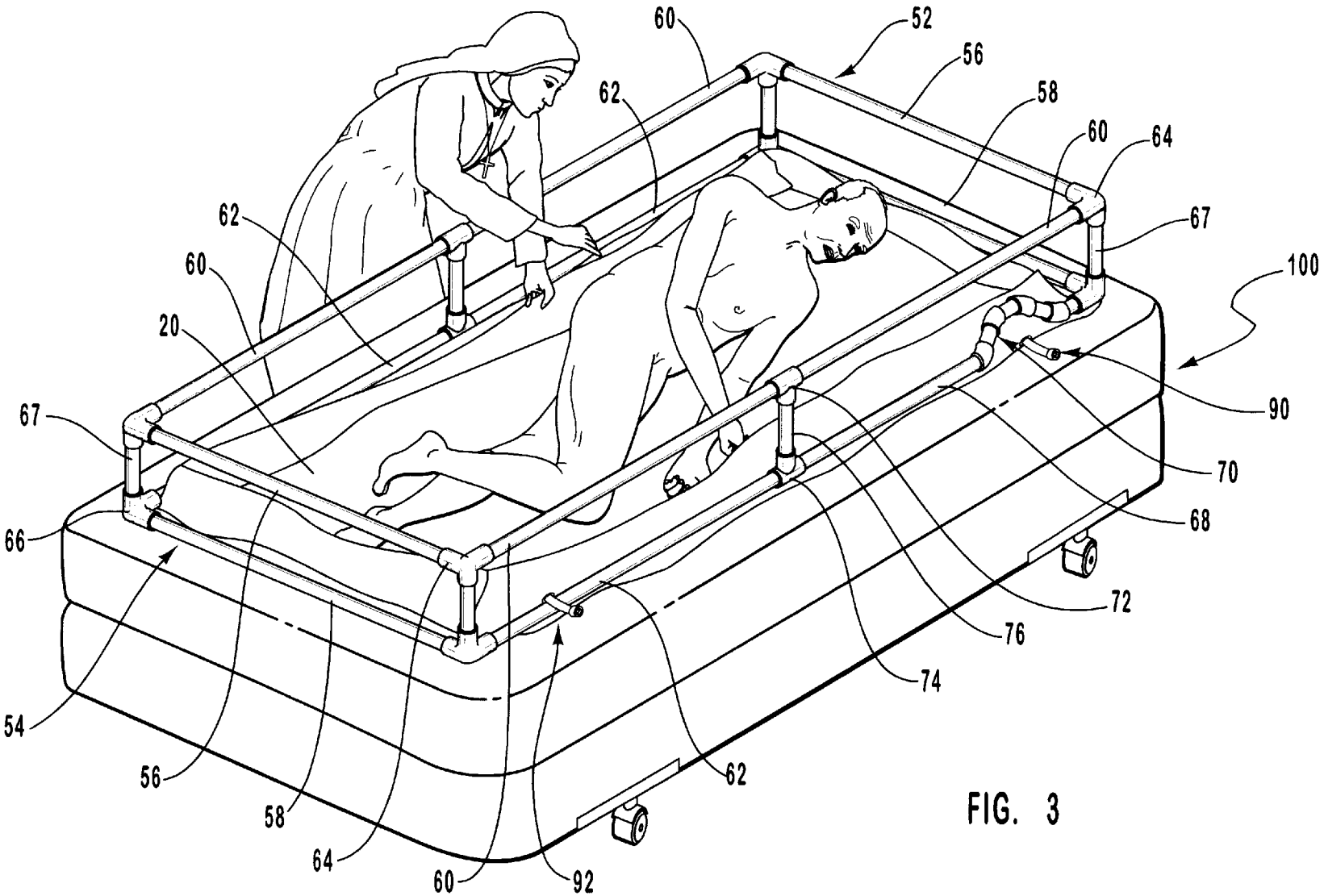
FIG. 3 is a perspective view of an embodiment of a modular frame surrounding a bedridden person lying on the extended, bur not yet attached, impermeable liner of the modular portable shower.

FIG. 1 shows shower 10 as assembled while FIGS. 2 and 3 depict the shower being assembled. As shown in FIG. 2, impermeable liner 20 is extended on bed 100 under the bedridden person by an attendant. Liner 20 can be extended and removed after use as easily as a bed sheet is changed under a patient. This operation is simple, requires no specialized skills by the attendant, imposes no taxing physical effort on the attendant and, most importantly, it merely requires the bedridden person to turn on one side for its extension on the bed or its removal from under the bedridden person.

The liner is preferably made of flexible, easily foldable material that is impermeable to water and it is not affected by the soaps or detergents that are ordinarily used in the maintenance and care-taking of the hygienic needs of a bedridden person. Another desirable property of the liner is that it be non-allergenic and/or have anti-bacterial or anti-fungal growth properties. Preferably, the embodiments of the liner of this invention are made of a translucent and more preferably opaque material that can give the bedridden person some privacy while taking a shower. Depending on the number of bedridden persons to whom showers must be administered, their physical conditions, and the prophylactic standards that must be observed, the liner of this invention can be embodied by a disposable impermeable liner or by a reusable impermeable liner. The material of which the reusable impermeable liner is made should preferably be resistant to soaps, detergents and other cleaning agents that will have to be used to keep it clean.

In a more preferred embodiment, the liner of this invention is made of Softic Ultralite ultralite material sold by VINTEX® and it can be accompanied by a water-proof pillow made with at least a sealed outer shell of the same material. The liner of this invention can be left on the bed as a mattress liner, a feature that considerably reduces the discomfort that could otherwise be caused to the bedridden person.

Because most top surfaces of bed mattresses are generally rectangular, the preferred shape of the liner in this invention is exemplified by impermeable liner 20 shown in FIG. 1. This preferred shape has a flat and generally rectangular base 22 whose perimeter defines the liner's lower edge 24. Liner walls 26 and 28 are preferably integrally attached to the liner's base 22 at the liner's lower edge 24. The impermeable liner 20 in FIG. 1 has two opposed head walls 28 and two opposed side walls 26 and each head wall 28 is preferably integrally attached to adjacent side walls 26 at commissures 30. Opposite to liner's lower edge 24, impermeable liner 20 has liner's upper edge 32 which is high enough above liner's base 22 as to prevent overspraying when the bedridden person is showered.

In the exemplary embodiment of this invention that incorproates a liner that can be left on the bed as a mattress liner or cover, walls 26 and 28 can be pulled downwards about edge 24 and be aligned around the mattress' perimeter while no shower is being administered to the bedridden person. This feature is facilitated by the flexible character of a preferred embodiment of the liner of this invention.

The liner means of this invention has attachment means for attaching the liner means to the frame means which supports the liner means. An exemplary embodiment of such attachment means is shown in FIG. 1 as a flap-and-snap system 34. In this preferred embodiment, liner's walls 26 and 28 are folded over the longitudinal elements of modular frame 50 and they are maintained in this position by a system of reciprocating interlocking devices that are attached to the impermeable liner and they are snapped together to hold liner's walls 26 and 28 in an upright position.

Another exemplary embodiment (not shown) of the attachment means for attaching the liner means could comprise an eyelet along liner's upper edge 32. In this exemplary embodiment of attachment means, short side members and long side members of modular frame 50 are threaded through the eyelet along the liner's upper edge 32, thereby holding the liner's walls 26 and 28 in an upright position for preventing water overspraying and even affording the bedridden person some privacy.

Another exemplary embodiment (not shown) of the attachment means for attaching the liner means could comprise a system like system 34 in FIG. 1 in which the reciprocating interlocking devices have been replaced by a series of holes or loops in the impermeable liner, and these holes or loops are maintained together by removable pins.

Another exemplary embodiment (not shown) of the attachment means for attaching the liner means could comprise a liner's upper edge 32 with a series of perforations along it. These perforations would match corresponding orifices in the longitudinal elements of modular frame 50 to which the liner would be held with the aid of removable pins.

The frame means of this invention can be placed in the configuration ready to hold the liner means either prior to or after the liner means is extended under the bedridden person and on top of the bed. Because of this feature, health care attendants in wards with numerous bedridden persons can independently begin setting up the modular portable shower on one bed without having to wait for all the components from another bed. In other words, liner means and frame means of a plurality of modular portable showers of this invention can be handled relatively independently from each other during the modular portable shower setting up and removal operations.

Figure 7:
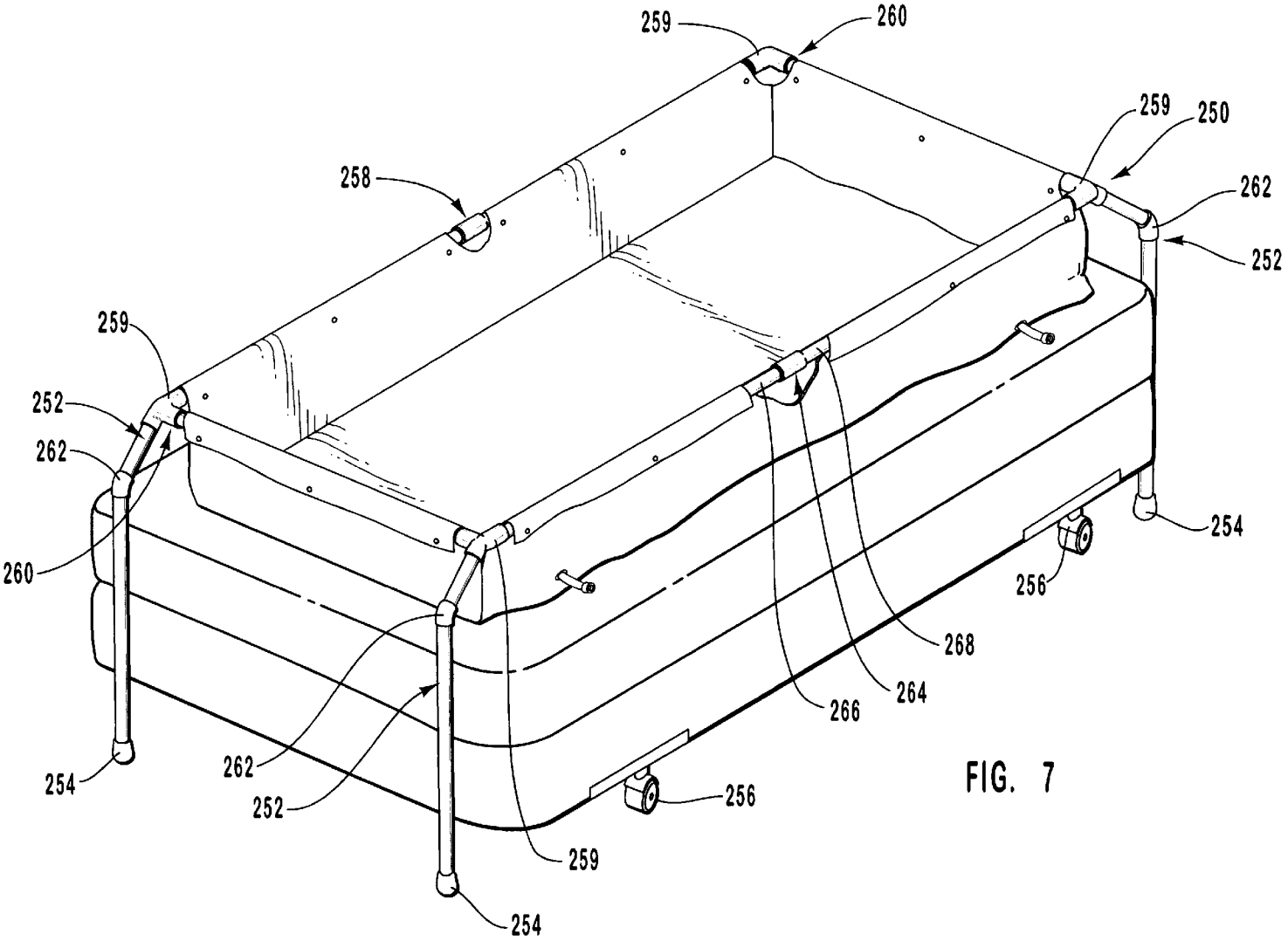
FIG. 7 is a perspective view of another embodiment of the modular portable shower.

Preferably, the liner means is extended on a bed before the frame means is assembled, as shown in FIGS. 2 and 3. The frame may be assembled on the bed and around the bedridden person or the modular frame may be assembled above or around the bed. An exemplary embodiment of a modular frame that rests on the bed and around the bedridden person is shown in FIGS. 1, 3, 4 and 5 as modular frame 50. An exemplary embodiment of a modular frame that rests on the floor and is disposed above or around the bed is shown in FIG. 7 as modular frame 250. Both frames are examples of frame means for supporting the liner means.

A preferred exemplary embodiment of the frame means comprises at least an assembly means for supporting the liner, and leg means for holding the assembly means above the bed. With the assembly means so held above the bed, the liner means drapes in a protected manner to minimize overspraying while showering a bedridden person.

The exemplary embodiment of modular frame 50 shown in FIGS. 1, 3, 4, and 5 comprises a generally rectangular top assembly 52 and a generally rectangular bottom assembly 54. Each one of these assemblies comprises side members that in turn may comprise subelements. Preferably, top assembly 52 of modular frame 50 comprises two opposed short top side members 56 and two opposed long top side members, in turn comprising top side subelements 60. Analogously, bottom assembly 54 of modular frame 50 comprises two opposed short bottom side members 58 and two opposed long bottom side members, in turn comprising bottom side subelements 62. Top assembly 52 and bottom assembly 54 are exemplary embodiments of assembly means for supporting the liner.

Side members of top assembly 52 are preferably assembled with the aid of connectors. Connectors in the context of this invention comprise, but are not limited to, T-shaped fittings, outlet elbows, and two- and three-way fittings. In a preferred embodiment, these connectors are three-way fittings, more preferably three-way fittings with side outlet elbows 64. Analogously, the side members of bottom assembly 54 are more preferably assembled with the aid of three-way fittings with side outlet elbows 66. Legs 67 which connect top assembly 52 to bottom assembly 54 exemplify an embodiment of leg means for holding the top assembly such that the liner means drapes in a protected manner to minimize overspraying while showering a bedridden person. Legs 67 in FIGS. 1–6 are preferably attached to the three-way fittings with side outlet elbows 64 with glue or some other adhesive, and in other embodiments they can also be integrally attached to the fittings.

Figure 5:
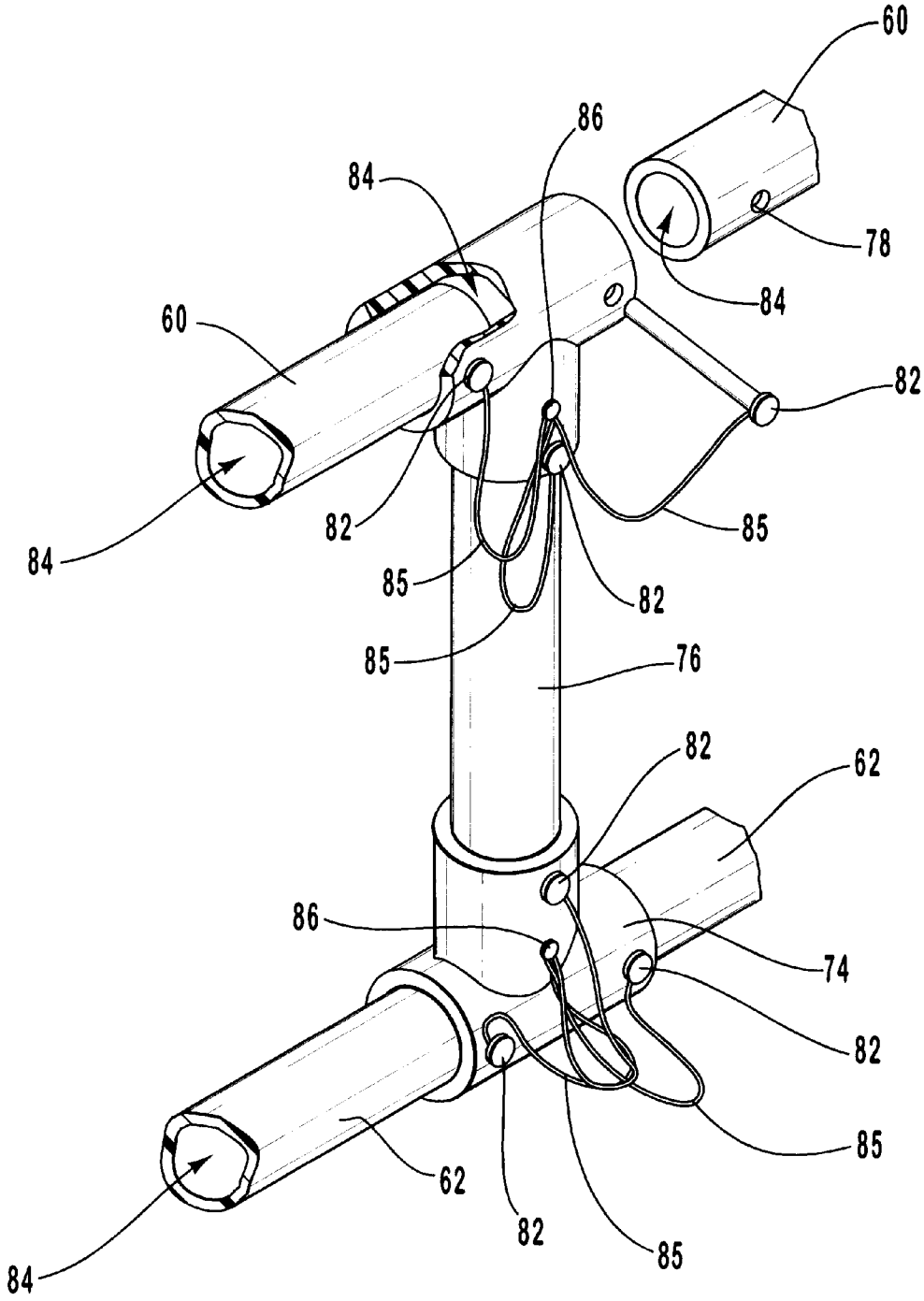
FIG. 5 is a perspective and partially cut away view of an embodiment of T-shaped elements connecting the ends of top and bottom side elements and a stabilizing member, showing also an embodiment of a pin-secured interlocking means with removable pins.

At least one of the side members of bottom assembly 54 should preferably allow for the working assembly of a drain for draining water from the liner means as the bedridden person is showered. An exemplary embodiment of a feature that conveniently allows for the working assembly of such a drain is shown in FIGS. 1, 3, and 5 as a non-collinear segment in bottom side subelement 68. This non-collinear segment can be embodied by arcuate portion 70. Side subelement 68 can be embodied by an integral subelement or by the exemplary embodiment shown in FIGS. 1, 3, and 5, in which arcuate portion 70 can be detachably connected to a linear portion of side subelement 68. Furthermore, the non-collinear segment of side subelement 68 may have a plurality of detachable subelements as shown in the exemplary embodiment of arcuate portion 70 or it can be an integral noncollinear segment.

In a preferred embodiment of modular frame 50, the long top side elements comprise top side subelements 60 and the long bottom side elements comprise bottom side subelements 62 and 68. Whether the side members of modular frame 50 comprise subelements or not is in part determined by a design choice that depends on the flexibility of the material used to manufacture these elements, on the storage limitations for the disassembled modular portable shower, and on the size of the modular portable shower itself. For example, the side elements of a modular portable shower for a small bed would preferably not comprise subelements, whereas each of the side elements of a modular portable shower for a large bed would preferably comprise at least two subelements.

In particular, side subelements 60 and 62, and short side members 56 and 58 can be designed in an embodiment of this invention (not shown) as having the same length and thus they can be interchangeable. An advantage of this configuration is that it facilitates the assembly of modular frame 50.

Adjacent top side subelements 60 are connected by top T-shaped elements 72 and adjacent bottom side subelements 62 and 68 are connected by bottom T-shaped elements 74. Stabilizing member 76 is an exemplary embodiment of an element that can be used as additional support to top assembly 52 and to confer additional structural stability to modular frame 50.

The terms "modular components" are used herein to collectively designate the plurality of components of any embodiment of the modular frame of this invention, such as legs, stabilizing members, detachable elements, and connectors.

The side members, legs, element connectors, stabilizing members, and T-shaped elements of modular frame 50 are preferably made of PVC pipe of the suitable diameter so that the ends or terminal portions of the side members, legs and stabilizing members fit snugly into the corresponding apertures of the element connectors and T-shaped elements with a friction fit. This design allows for a simple and quick assembly and disassembly of modular frame 50, and it is a preferred design when the modular portable shower is not used so intensely that the connections of the different modular components would become loose as a consequence of wear. When it is suspected that wear may lead to fitting problems, a preferred design for the element connectors and T-shaped elements of the modular portable shower is shown in FIG. 5 by an exemplary embodiment of T-shaped elements, terminal portions of side subelements and stabilizing member, with the understanding that a person of ordinary skill in the art would be able to implement analogous modifications into the element connectors, legs and corresponding end portions of side members or side subelements of modular frame 50.

FIG. 5 depicts modular components detachably secured together by removable pins 82. In the example shown in FIG. 5, the terminal portions of top side subelements 60, bottom side subelements 62 and stabilizing member 76 are provided with orifices 78 that match corresponding orifices 80 in top T-shaped element 72 and bottom T-shaped element 74. Optionally, pins 82 can be attached to T-shaped elements 72 and 74 with the aid of strings, chains, lines, wires, cables or any other similar fastening devices to avoid misplacing or losing pins 82. Pins 82 are an exemplary embodiment of interlocking means for detachably securing a plurality of modular components of the modular portable shower.

Another exemplary embodiment of a pin-secured interlocking means for detachably securing a plurality of modular components of the modular portable shower comprises a system of spring-loaded pins in the ends or terminal portions of the modular components. For example, spring-loaded pins may be installed at the terminal portions of top side subelements 60, bottom side subelements 62 and stabilizing member 76 that extend outwards and into corresponding orifices 80 drilled into top T-shaped element 72 and bottom T-shaped element 74.

Pins 82 shown in FIG. 5 are a preferred feature of the modular components of the modular portable shower of this invention. Accordingly, the modular components are hollow as illustrated by the empty spaces 84 shown in the exemplary embodiment of FIG. 5. This feature makes of the modular portable shower a light and yet structurally stable shower. Pins 82 are also preferably secured by a line 85 to an anchor pin 86 which is secured to connectors 72 and 74 such that when removable pins 82 are removed from orifices 78 the pins 82 hang from the connectors. Line 85 and anchor pin 86 are an example of a securing means for securing the interlocking means to a modular component, particularly the connectors. In another embodiment of modular frame 50 (not shown), the terminal portions of connectors 72 and 74 can fit into the corresponding terminal portions of side subelements 60 and 62 and stabilizing member 76, in which case anchor pins 86 would be secured to any of side subelements 60 or 62 or to stabilizing member 76.

Figure 6:
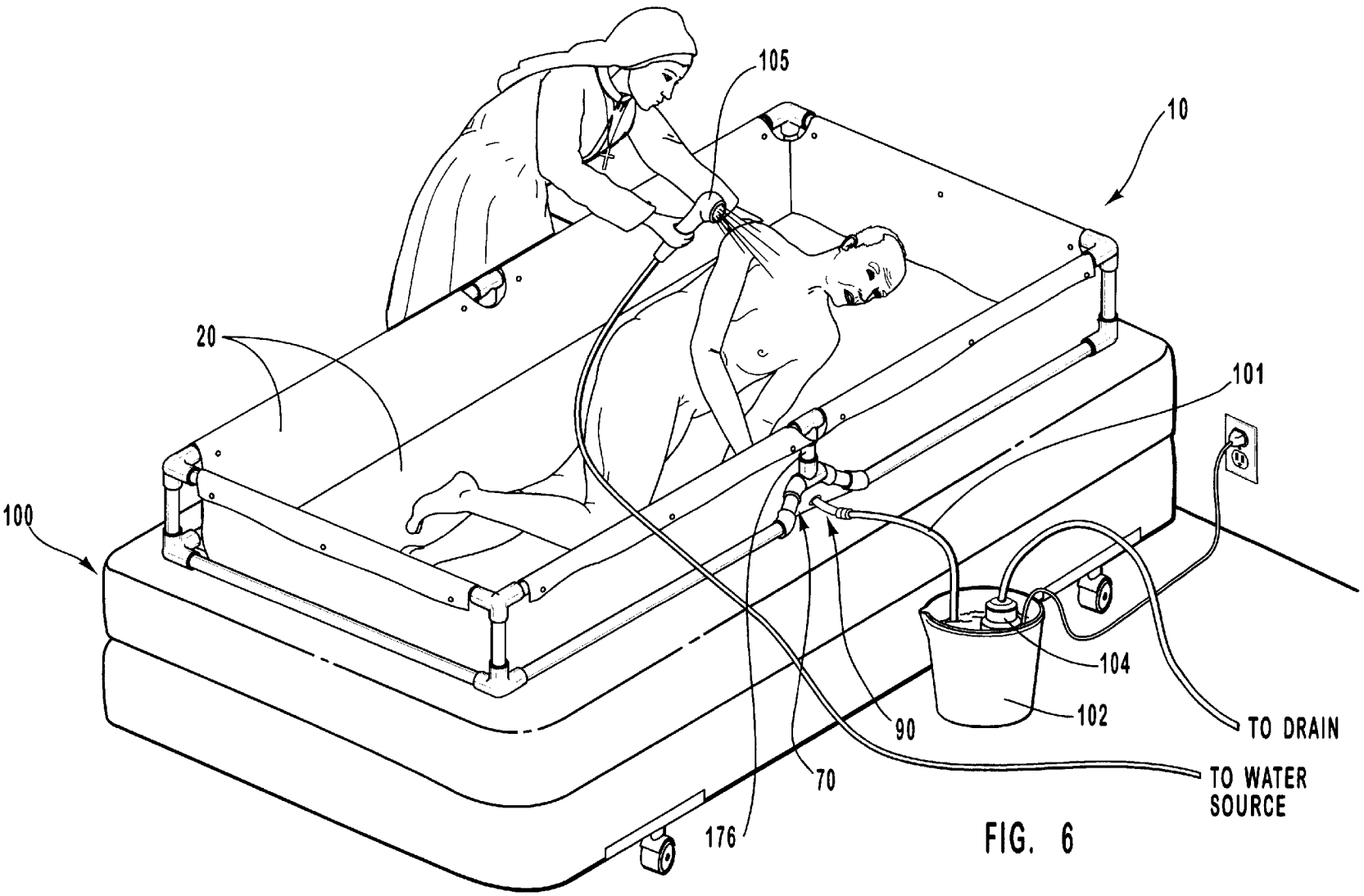
FIG. 6 is a perspective view of the embodiment shown in FIG. 1 while a shower is administered to a bedridden person and water is drained out of the modular portable shower.

FIG. 6 shows an exemplary embodiment of a system for administering a shower to a bedridden person with an embodiment of the modular portable shower. In addition to an embodiment of shower 10, the system shown in FIG. 6 also has pump 104 that is an example of pump means for discharging water drained from the drain means of the shower to a disposal system, and sprayer 105 that is an exemplary embodiment of shower means for delivering water to the shower. Pump 104 as shown in FIG. 6 pumps the water from container 102, but in other embodiments (not shown) it could be connected directly to drain 90 by extension tube 100. Pump 104 is preferably electrically powered and quiet while it operates. Sprayer 105 is connected to a water source that provides the water for showering the bedridden person.

The liner means of this invention preferably comprises a drain means for draining water from the liner means when the bedridden person takes a shower. An exemplary embodiment of this drain means preferably comprises at least one orifice through the liner means and it more preferably further includes a quick connect device such as a tubular feature attached in fluid tight contact to the liner means around this orifice. An exemplary embodiment of a drain means for draining water from the liner is illustrated in FIGS. 1, 3, 4, 6 and 7 at 90. Drain 90 includes orifice 94 and tubular member 96 which has a terminal portion 98 that is preferably adapted for connecting to an extension tube 100 for facilitating the evacuation of the water away from the bed. Extension tube 100 may discharge the water directly into a disposal system or into a container 102 that can be manually emptied or that is optionally provided with a pump 104 for discharging the water into a disposal system.

The exemplary embodiment depicted in FIG. 6 shows a preferred position for drain 90 that is located about half way along the long side of liner 20. More generally, the preferred position of drain 90 is in the region of the liner that will be naturally depressed due to the weight of the bedridden person, a region that is likely to be below the person's abdominal area, particularly when the head of the bedridden person rests on a pillow. FIG. 6 also shows a stabilizing member 176 being detachably connected to arcuate portion 70.

Orifice 94 is preferably located next to liner's lower edge 24 to facilitate the draining of the water as the bedridden person is taking a shower. The accumulation of water within the receptacle defined by the impermeable liner of this invention is preferably kept to a minimum.

Figure 4:
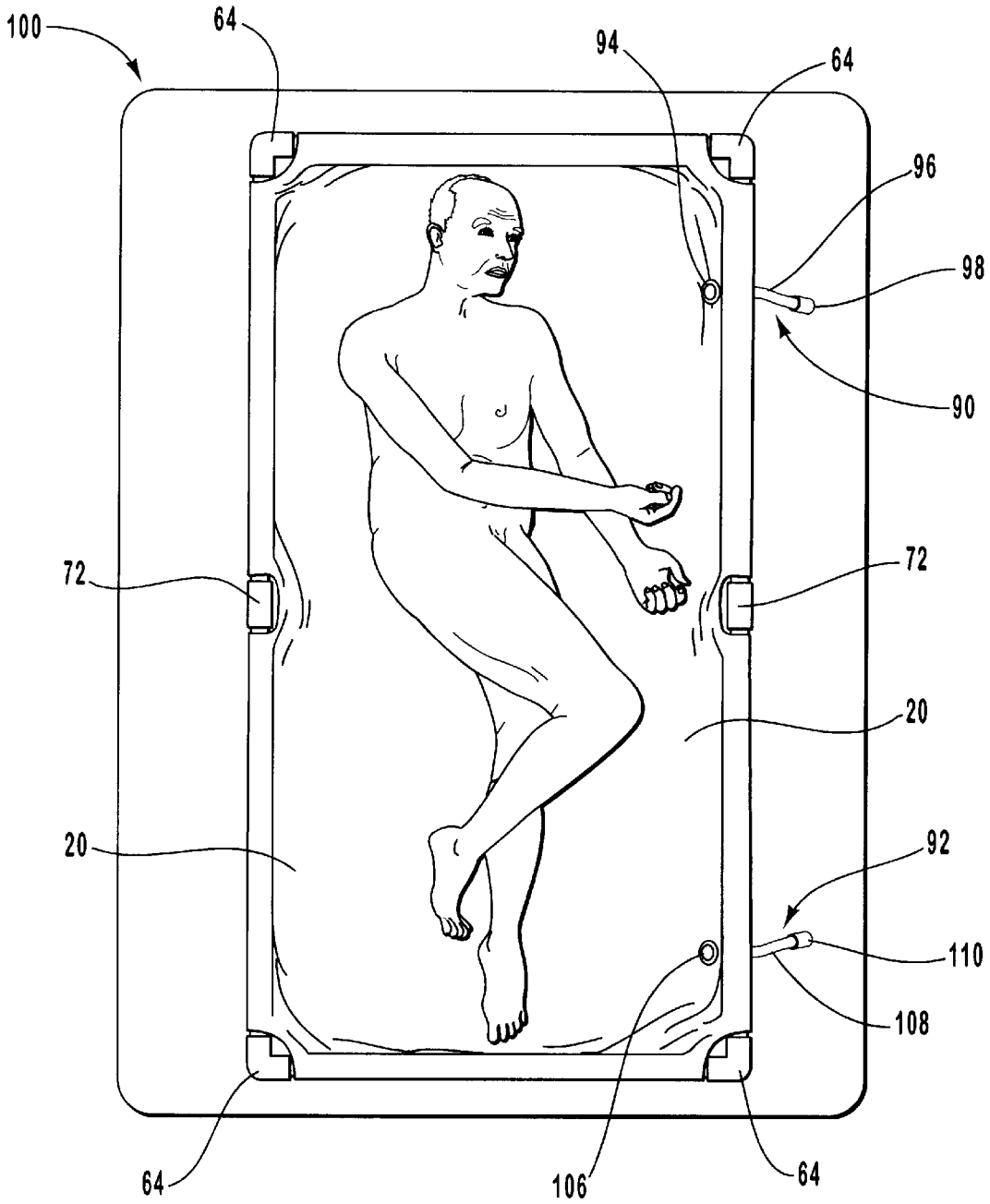
FIG. 4 is a top view of the embodiment shown in FIG. 1.

In addition, the drain means for draining water from the liner means may comprise other orifices and tubular features such as those in the exemplary embodiment of another drain shown at 92. Drain 92, as shown in FIG. 4, comprises orifice 106 and tubular feature 108 which can optionally be kept closed with a removable fluid tight seal or cap 110 when not in use.

The frame means of this invention does not require a bottom assembly, as leg means provide support. Leg means can provide support entirely on the bed, entirely on the floor, or partially on the bed and partially on the floor.

Another exemplary embodiment of the modular portable shower of this invention is illustrated in FIG. 7 with frame means exemplified by modular frame 250. Legs 252 are another example of leg means for holding the top assembly such that the liner means drapes in a protected manner to minimize overspraying. In this embodiment, legs 252 extend beyond the bed surface all the way to the floor and are fitted for providing stable support. Legs 252 have high-friction contact covers 254 for contacting the floor and minimizing movement, but it is understood that another exemplary embodiment of this invention could have leg means fitted with rolling ends, such as wheels 256, for facilitating the displacement of a frame means such as modular frame 250 from one bed to another without having to disassemble it. This would be a preferred feature in a design of an embodiment of the portable shower of this invention that is to be used at a health care facility or residence with a plurality of bedridden persons.

Although the embodiment of modular frame 250 shown in FIG. 7 displays legs 252 that are coplanar with long side member 258 to which they are detachably connected by element connector 259, this is not a limitation of the frame means or a limitation of the leg means in this invention. In another embodiment of modular frame 250, legs 252 could be coplanar with the short side member 260 to which they are detachably connected by element connector 259. Still in another embodiment of modular frame 250, the plane within which each one of legs 252 is contained could bisect the angle defined by long side member 258 and short side member 260. A bisection of this angle in approximately equal halves would be a preferred configuration for an embodiment of modular frame 250 that comprises legs 252 with rolling ends, such as wheels 256. Additionally, modular frame 250 can be larger than the bed, so that leg means can be embodied by legs that extend straight to the floor.

Legs 252 in the exemplary embodiment shown in FIG. 7 comprise two modular components detachably connected by arcuate element connector 262. In another exemplary embodiment, each one of legs 262 may be an integral leg extending from element connector 259 to the floor.

An overall preferred shape for a preferred embodiment of the modular portable shower of this invention is a shape generally defined by an overall parallelepipedic contour, as shown in FIG. 1 for a preferred embodiment of the liner and modular frame shown therein. Other non-parallelepipedic shapes can be designed by obvious variations performed on the exemplary embodiments of this invention herein shown and described. For example, other exemplary embodiments of this invention (not shown) could have at least one assembly with a shape including straight and curved features, or the shape could be circular, oviodal, ellipsoidal, or polygonal.

It is understood that the modular portable shower of this invention could be embodied by a frame means with leg means at one end such as legs 67 shown in FIGS. 1,3,4, and 6, and with leg means at the opposite end like legs 252 shown in FIG. 7. Particularly in this embodiment of the modular portable shower, the frame means could be embodied by a top assembly that has opposite short side members of different length.

Furthermore, the liner means, or more preferably the modular components of the frame means of this invention could be provided with molded, integrally attached, or detachably connected, as appropriate, means for aiding in the manipulation of the frame means, such as straps, loops, handles and slots and combinations and equivalents thereof. This is a feature, however, that any person of ordinary skill in the art would be able to incorporate into any embodiment of this invention. Similarly, the liner means and the modular components of this invention could be provided with molded, integrally attached or detachably connected means for storing miscellaneous items such as hygienic products and implements, or even patient records. This means for storing could be embodied for example by bags, pouches, hooks, hangers and combinations and equivalents thereof. This is another feature that any person of ordinary skill in the art would also be able to incorporate into any embodiment of this invention.

The exemplary embodiment 250 of the modular portable shower of this invention illustrates examples of a plurality of different ways of detachably connecting the modular components in addition to the exemplary embodiments 64, 72, and 76 shown in FIGS. 1, 3, 4, 5, and 6. In particular, an element connector can be embodied by a design which requires a three-way fitting with side outlet elbows that define angles different from 90°, as in element connector 259. Modular components can also be detachably connected when design so requires by arcuate element connectors 262.

In another exemplary embodiment of this invention, modular components could be detachably connected to each other by inserting the terminal portion of one component into the enlarged terminal portion of an adjacent component. This is exemplified in FIG. 7 by detachable connection 264 between side subelements 266 and 268. This type of connection between adjacent modular components allows for easy length adjustment which can be accomplished by varying the length of a terminal portion of a modular component that is inserted into the enlarged terminal portion of an adjacent modular component. Moreover, short side members 260 may also have slidably engaged subelements by means of a connection like detachable connection 264.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A modular portable shower for a bedridden person, comprising:

liner means for receiving a bedridden person in a manner such that the bedridden person can remain on a bed while being showered, wherein said liner means is sufficiently water impermeable to prevent water from passing through the liner means;

assembly means for supporting the liner means, said assembly means having modular components including detachable elements configured such that the assembly means has four sides including two short opposing sides and two long opposing sides;

attachment means for attaching said liner means to said assembly means;

leg means for holding the assembly means such that the liner means drapes in a protected manner to minimize overspraying water out of the shower while showering a bedridden person; and drain means for draining water from said liner means as a bedridden person is showered, and wherein at least one of said detachable elements has at least one arcuate portion for allowing the free draining of the water in said liner means through said drain means.

2. A modular portable shower as recited in claim 1, wherein said liner means comprises a flat base with four walls extending upwards from said base, said walls ending at an upper edge, and said walls being integrally attached to said flat base along a lower edge opposite to said upper edge.

3. A modular portable shower as recited in claim 1, wherein said liner means comprises a flat base with four walls extending upwards from said base, and wherein said walls comprise a head wall, a bottom wall, and two opposing side walls each extending from said head wall to said bottom wall.

4. A modular portable shower as recited in claim 1, wherein said modular components further include element connectors and wherein said detachable elements of said assembly means are side members, the side members being detachably connected to each other by the element connectors.

5. A modular portable shower as recited in claim 1, wherein said modular components further include element connectors, and wherein said detachable elements of said assembly means are side members, the side members being detachably connected to each other by element connectors which are three-way fittings.

6. A modular portable shower as recited in claim 1, wherein said modular components further include element connectors, and wherein said detachable elements of said assembly means are side members, the side members being detachably connected to each other by the element connectors which are T-shaped fittings and side outlet elbows.

7. A modular portable shower as recited in claim 1, wherein said modular components further include element connectors, and wherein said detachable elements of said assembly means are side members, the side members being detachably connected to each other by the element connectors and wherein the shower further comprises interlocking means for detachably securing the modular components together.

8. A modular portable shower as recited in claim 1, wherein said modular components further include element connectors, and wherein said detachable elements of said assembly means are side members, the side members being detachably connected to each other by the element connectors and wherein the shower further comprises removable pins for detachably securing the modular components together.

9. A modular portable shower as recited in claim 1, wherein said assembly means includes a rectangular top assembly coupled to a rectangular bottom assembly via at least four legs, said rectangular top assembly including two short top side members, two long top side members, and at least four top element connectors, each top element connector being configured to receive an end of a long top side member and an end of a short top side member such that the short top side members of the top assembly are opposed and the long top side members of the top assembly are opposed, said rectangular bottom assembly including two short bottom side members, two long bottom side members, and at least four bottom element connectors, each bottom element connector being configured to receive an end of a long bottom side member and an end of a short bottom side member such that the short bottom side members of the bottom assembly are opposed and the long bottom side members of the bottom assembly are opposed, and each one of said top element connectors being detachably connected with one of said bottom element connectors by one of said legs.

10. A modular portable shower as recited in claim 9, wherein at least one of said long top side members comprises a plurality of detachable top side subelements and at least one top T-shaped element connector detachably connecting a pair of said detachable top side subelements adjacent to each other, and wherein at least one of said long bottom side members comprises a plurality of detachable bottom side subelements and at least one bottom T-shaped element connector detachably connecting a pair of said detachable bottom side subelements adjacent to each other, and wherein each top T-shaped element connector is detachably connected with one bottom T-shaped element connector by a stabilizing member.

11. A modular portable shower as recited in claim 1, wherein said modular components of said assembly means are PVC pipe.

12. A modular portable shower as recited in claim 1, wherein said liner means comprises a flat base with four walls extending upwards from said base, said walls ending at an upper edge, and wherein the attachment means are located in the upper edge of said liner means.

13. A modular portable shower as recited in claim 1, wherein said attachment means comprises a plurality of corresponding flaps and snaps.

14. A modular portable shower as recited in claim 1, wherein said liner means comprises a flat base with four walls extending upwards from said base, said walls ending at an upper edge, and said walls being integrally attached to said flat base along a lower edge opposite to said upper edge, and wherein said drain means is fixed in one of said walls, next to and above said lower edge.

15. A modular portable shower as recited in claim 1, wherein said assembly means includes a rectangular top assembly coupled to a rectangular bottom assembly, and wherein the drain means is located in one of the detachable elements of the rectangular bottom assembly.

16. A modular portable shower as recited in claim 1, wherein said assembly means includes a rectangular top assembly coupled to a rectangular bottom assembly the rectangular bottom assembly includes two short bottom side members, two long bottom side members and element connectors which couple the short bottom side members and top side members together in a rectangular configuration, and wherein the drain means is located in one of the side members of the rectangular bottom assembly.

17. A modular portable shower for a bedridden person, comprising:

liner means for receiving a bedridden person in a manner such that the bedridden person can remain on a bed while being showered with water, wherein said liner means is sufficiently water impermeable to prevent water from passing through the liner means;

assembly means for supporting the liner means, said assembly means having modular components including detachable elements configured such that the assembly means has four sides including two short opposing sides and two long opposing sides;

attachment means for attaching said liner means to said assembly means;

leg means for holding the assembly means such that the liner means drapes in a protected manner to minimize overspraying while showering a bed ridden person; and drain means for draining water from said liner means as a bedridden person is showered, said drain means being fixed in said liner means and wherein at least one of said detachable elements has at least one arcuate portion for allowing the free draining of the water in said liner means through said drain means.

18. A modular portable shower for a bedridden person, comprising:

a liner adapted to receive a bedridden person in a manner such that the bedridden person can remain on a bed while being showered with water, wherein said liner is sufficiently water impermeable to prevent water from passing through the liner;

a rectangular modular assembly adapted for use with a bed and to support the liner, said assembly having modular components including detachable elements configured such that the assembly has four sides including two short opposing sides and two long opposing sides;

attachment means for attaching said liner to said assembly;

leg means for holding the assembly such that the liner drapes in a protected manner to minimize overspraying while showering a bed ridden person; and a drain for draining water from said liner as a bedridden person is showered, said drain being fixed in said liner and wherein at least one of said detachable elements has at least one arcuate portion for allowing the free draining of the water in said liner means through said drain.

19. A modular portable shower for a bedridden person, comprising:

a liner being adapted to receive a bedridden person in a manner such that the bedridden person can remain on a bed while being showered with water, wherein said liner is sufficiently water impermeable to prevent water from passing through the liner;

a modular frame adapted for use with a bed, said frame having a rectangular top assembly detachably maintained above a rectangular bottom assembly via at least four legs, said rectangular top assembly including two short top side members, two long top side members, and at least four top element connectors, each top element connector being configured to receive an end of a long top side member and an end of a short top side member, such that the short top side members of the top assembly are opposed and the long top side members of the top assembly are opposed, said rectangular bottom assembly including two short bottom side members, two long bottom side members, and at least four bottom element connectors, each bottom element connector being configured to receive an end of a long bottom side member and an end of a short bottom side member, such that the short bottom side members of the bottom assembly are opposed and the long bottom side members of the bottom assembly are opposed, each of said legs having an end coupled to a top element connector and another end coupled to a bottom element connector;

attachment means for attaching said liner to said top assembly; and drain means for draining water from said liner as a bedridden person is showered, said drain means being fixed in said liner and wherein at least one of said bottom side members has at least one arcuate portion for allowing the free draining of the water in said liner means through said drain means.

20. A system for showering a bedridden person, comprising:

a modular portable shower including liner means for receiving a bedridden person in a manner such that the bedridden person can remain on a bed while being showered, wherein said liner means is sufficiently water impermeable to prevent water from passing through the liner means;

assembly means for supporting the liner, said assembly means having modular components including detachable elements configured such that the assembly means has four sides including two short opposing sides and two long opposing sides;

attachment means for attaching said liner means to said assembly means;

leg means for holding the assembly means such that the liner means drapes in a protected manner to minimize overspraying water out of the shower while showering a bedridden person; and drain means for draining water from said liner means as a bedridden person is showered, and wherein at least one of said detachable elements has at least one arcuate portion for allowing the free draining of the water in said liner means through said drain means;

pump means for discharging water drained from the drain means of the shower to a disposal system; and shower means for delivering water to the shower.

* * * * *